US010049777B2

(12) United States Patent
Singh

(10) Patent No.: US 10,049,777 B2
(45) Date of Patent: Aug. 14, 2018

(54) METHOD FOR STORING RADIOACTIVE WASTE, AND SYSTEM FOR IMPLEMENTING THE SAME

(71) Applicant: HOLTEC INTERNATIONAL, INC., Marlton, NJ (US)

(72) Inventor: Krishna P. Singh, Hobe Sound, FL (US)

(73) Assignee: Holtec International, Inc.

( * ) Notice: Subject to any disclaimer, the term of this patent is extended or adjusted under 35 U.S.C. 154(b) by 823 days.

(21) Appl. No.: 14/358,032

(22) PCT Filed: Nov. 14, 2012

(86) PCT No.: PCT/US2012/065117

§ 371 (c)(1),
(2) Date: May 13, 2014

(87) PCT Pub. No.: WO2013/115881

PCT Pub. Date: Aug. 8, 2013

(65) Prior Publication Data

US 2014/0329455 A1 Nov. 6, 2014

Related U.S. Application Data

(60) Provisional application No. 61/559,251, filed on Nov. 14, 2011.

(51) Int. Cl.

| | |
|---|---|
| ***G21F 5/10*** | (2006.01) |
| ***G21F 5/005*** | (2006.01) |
| ***G21F 5/008*** | (2006.01) |

(52) U.S. Cl.
CPC ..... *G21F 5/10* (2013.01); *G21F 5/005* (2013.01); *G21F 5/008* (2013.01)

(58) Field of Classification Search
CPC ..... G21F 5/10; G21F 5/008
See application file for complete search history.

(56) References Cited

U.S. PATENT DOCUMENTS 3,448,859 A * 6/1969 Barker ..... G21F 9/20 210/416.1
3,945,509 A * 3/1976 Weems ..... G21F 5/14 187/343

(Continued)

OTHER PUBLICATIONS

Corresponding International Search Report dated Jul. 19, 2013.

*Primary Examiner* — Nathaniel Herzfeld
(74) *Attorney, Agent, or Firm* — The Belles Group, P.C.

(57) ABSTRACT

A system and method for storing high level radioactive waste, such as spent nuclear fuel. In one embodiment, the invention is a method of storing high level radioactive waste comprising: a) positioning a metal canister containing high level radioactive waste having a heat generation rate in a storage cavity of a ventilated system comprising a cask body, a cask lid positioned atop the cask body, at least one outlet duct extending from a top of the storage cavity to an ambient atmosphere, and a plurality of inlet ducts, each of the inlet ducts extending from a first opening in the outer surface of the cask body to a second opening in the inner surface of the cask, body; and b) sealing selected ones of the plurality of inlet ducts over time as a function of a decay of the heat generation rate to maintain more a predetermined percentage of a vertical height of the metal canister above a predetermined threshold temperature.

25 Claims, 7 Drawing Sheets

(56) References Cited

U.S. PATENT DOCUMENTS

| | | | | | |
|---|---|---|---|---|---|
| 4,498,011 | A * | 2/1985 | Dyck | G21F 5/10 | 250/507.1 |
| 4,532,428 | A * | 7/1985 | Dyck | G21F 5/008 | 250/506.1 |
| 4,634,875 | A * | 1/1987 | Kugeler | G21F 5/005 | 250/506.1 |
| 4,649,018 | A * | 3/1987 | Waltersdorf | G21F 9/36 | 250/507.1 |
| 4,834,916 | A * | 5/1989 | Chaudon | G21F 9/34 | 250/506.1 |
| 5,564,498 | A * | 10/1996 | Bochard | G21C 15/12 | 165/169 |
| 5,641,970 | A * | 6/1997 | Taniuchi | G21F 5/10 | 250/506.1 |
| 5,753,925 | A | 5/1998 | Yamanaka et al. | | |
| 5,786,611 | A * | 7/1998 | Quapp | G21F 1/042 | 250/515.1 |
| 6,252,923 | B1 | 6/2001 | Iacovino et al. | | |
| 6,519,307 | B1 * | 2/2003 | Singh | G21F 5/10 | 250/506.1 |
| 6,873,673 | B2 * | 3/2005 | Georgii | G21F 5/10 | 250/506.1 |
| 2003/0028065 | A1 * | 2/2003 | Matsunaga | G21F 5/008 | 588/16 |
| 2010/0027733 | A1 * | 2/2010 | Cantonwine | G21C 3/32 | 376/434 |
| 2010/0284506 | A1 * | 11/2010 | Singh | G21F 5/005 | 376/272 |
| 2011/0172484 | A1 | 7/2011 | Singh et al. | | |
| 2012/0037632 | A1 | 2/2012 | Singh et al. | | |
| 2014/0247916 | A1 * | 9/2014 | Singh | G21F 5/06 | 376/272 |

* cited by examiner

Ventilated Cask Air Temperature Profile Using Prior Art VVO of FIG. 1

Canister Axial Surface Temperature Profile When Stored in Prior Art VVO of FIG. 1

SCC Prone Zone Minimization by Distributed Inlets Design

METHOD FOR STORING RADIOACTIVE WASTE, AND SYSTEM FOR IMPLEMENTING THE SAME

CROSS-REFERENCE TO RELATED PATENT APPLICATIONS

The present application is a U.S. national stage application under 35 U.S.C. § 371 of PCI' Application No. PCT/US2012/065117, filed Nov. 14, 2012, which claims the benefit of U.S. Provisional Patent Application Ser. No. 61/559,251, filed Nov. 14, 2011, the entireties of which are incorporated herein by reference.

FIELD OF THE INVENTION

The present invention relates generally to a system and method for storing radioactive waste, such as spent nuclear fuel and/or other high level radioactive waste, and specifically to a ventilated storage system, such as an overpack system or vault, that is used in the nuclear industry to provide physical protection and/or radiation shielding, to canisters containing radioactive waste that generates heat.

BACKGROUND OF THE INVENTION

In the operation of nuclear reactors, it is customary to remove fuel assemblies after their energy has been depleted down to a predetermined level. Upon removal, this spent nuclear fuel ("SNF") is still highly radioactive and produces considerable heat, requiring that great care be taken in its packaging, transporting, and storing. In order to protect the environment from radiation exposure, SNF is first placed in a canister, which is typically a hermetically sealed canister that creates a confinement boundary about the SNF. The loaded canister is then transported and stored in a large cylindrical container called a cask. Generally, a transfer cask is used to transport spent nuclear fuel from location to location while a storage cask is used to store SNP for a determined period of time.

One type of storage cask is a ventilated vertical overpack ("VVO"). A VVO is a massive structure made principally from steel and concrete and is used to store a canister loaded with spent nuclear fuel. VVOs come in both above-ground and below-grade versions. In using a VVO to store SNF, a canister loaded with SNF is placed in the cavity of the body of the VVO. Because the SNP is still producing a considerable amount of heat when it is placed in the VVO for storage, it is necessary that this heat energy have a means to escape from the VVO cavity. This heat energy is removed from the outside surface of the canister by ventilating the VVO cavity. In ventilating the VVO cavity, cool air enters the VVO chamber through air-inlet ducts, flows upward past the loaded canister as it is warmed from the heat emanating from the canister, and exits the VVO at an elevated temperature through air-outlet ducts. Such VVOs do not require the use of equipment to force the air flow through the VVO. Rather, these VVOs are passive cooling systems as they use a natural convective flow of air induced by the heated air to rise within the VVO (also know as the chimney effect).

While it is necessary that the VVO cavity be vented so that heat can escape from the canister, it is also imperative that the VVO provide adequate radiation shielding and that the SNF not be directly exposed to the external environment. Being that VVOs (and the canisters loaded therein) are intended to be used as long term storage solutions for SNF, it is imperative that both VVOs and the canisters exhibit a long life, in which corrosion, cracking and/or any type of compromise of structural integrity is minimized and/or avoided entirely.

SUMMARY OF THE INVENTION

Stress Corrosion Cracking (SCC) of stainless steel nuclear waste canisters and containers in storage at costal sites with harsh marine environments is an important issue receiving increased industry and regulatory scrutiny. The root causes of SCC are present to some degree in all high level, radioactive waste ("HLW") storage and transport canisters: (i) sensitization caused by heating; (ii) stress; and (iii) the presence of corrosive elements. Canister designers and manufactures takes preventative measures to minimize the chance of SCC developing by maintaining controlled temperatures during welding processes and engineering large conservative margins into our canisters to keep stresses at a minimum.

Investigations on SCC have demonstrated that SCC has a strong dependence on the surface temperature of the stainless steel canister. The dependence on the surface temperature is driven by the mechanism of deposit of airborne containments (e.g. chlorides) and subsequent deliquesce of those containments on the stainless steel surface. A higher surface temperature decreases the relative humidity of the air adjacent to the surface and prevents deliquesce the contaminants and subsequent penetration into the stainless steel surface, a precursor for SCC.

The canister surface temperature of a ventilated storage system depends on the heat generation rate of the canister contents and the overall heat rejection rate of the storage system (i.e., heat transfer rate to the surrounding environment). Due to the high heat generation rates of SNF during the first 20 years of storage, SCC is not believed to be a problem for canisters loaded with SNF due to the surface temperature dependence on the deliquesce of the salt deposits that may be carried by the cooling air in a marine environment. However, as the heat generation rate of the SNF subsides due to radioactive decay processes, the canister surface temperature will decrease and, therefore, the canister may become prone to SCC.

In one embodiment, the invention can be a ventilated system for storing high level radioactive waste comprising: a cask body comprising an outer surface and an inner surface forming a storage cavity for receiving high level radioactive waste; a cask lid positioned atop the cask body and enclosing a top end of the storage cavity; at least one outlet duct extending from a top of the storage cavity to an ambient atmosphere; a plurality of inlet ducts of the inlet ducts extending from a first opening in the outer surface of the cask body to a second opening in the inner surface of the cask body, the plurality of inlet ducts comprising a lowermost set of inlet ducts and an uppermost set of inlet ducts; and wherein the second openings of the lowermost set of air inlet ducts are located at a first vertical distance from a bottom end of the cask body and the second openings of the uppermost set of air inlet ducts are located at a second vertical distance from the bottom end of the cask body, the second vertical distance being greater than the first vertical distance.

In another embodiment, the invention can be a ventilated system for storing high level radioactive waste comprising: a cask body comprising a bottom end, a top end, an outer surface and an inner surface, the inner surface forming a storage cavity for receiving high level radioactive waste, the cask body extending along a vertical axis from the bottom end to the top end and having a vertical height measured from the bottom end of the cask body to the top end of the cask body; a cask lid positioned atop the cask body and enclosing a top end of the storage cavity; at least one outlet duct extending from a top of the storage cavity to an ambient atmosphere; a plurality of inlet ducts, each of the inlet ducts extending from a first opening in the outer surface of the cask body to a second opening in the inner surface of the cask body; the cask body comprising a lower axial section and an upper axial section, wherein the lower axial section is defined from the bottom end of the cask body to a vertical height of an uppermost one of the second openings of the plurality of air inlet ducts, and wherein the upper axial section is defined from the top end of the cask body to the vertical height of the uppermost one of the second openings of the plurality air inlet ducts; a metal canister containing high level radioactive waste positioned within the storage cavity so that an annular gap exists between an outer surface of the metal canister and the inner surface of the cask body, the annular gap forming a passageway from the second openings of the plurality of the inlet ducts to the at least one outlet duct; the second openings of the plurality of air inlet ducts arranged in a pattern on the inner surface of the cask body along the lower axial section; and wherein the pattern is configured and the vertical height of the uppermost, one of the second openings is selected to maintain more than 90% of a vertical height of the metal canister above a predetermined threshold temperature for a predetermined heat generation rate of the high level radioactive waste.

In yet another embodiment, the invention can be a method of storing high level radioactive waste comprising: a) positioning a metal canister containing high level radioactive waste having a heat generation rate in a storage cavity of a ventilated system comprising a cask body, a cask lid positioned atop the cask body, at least one outlet duct extending from a top of the storage cavity to an ambient atmosphere, and a plurality of inlet ducts, each of the inlet ducts extending from a first opening in the outer surface of the cask body to a second opening in the inner surface of the cask body; and b) sealing selected ones of the plurality of inlet ducts over time as a function of a decay of the heat generation rate to maintain a predetermined percentage of a vertical height of the metal canister above a predetermined threshold temperature.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE DRAWINGS

Figure 1:
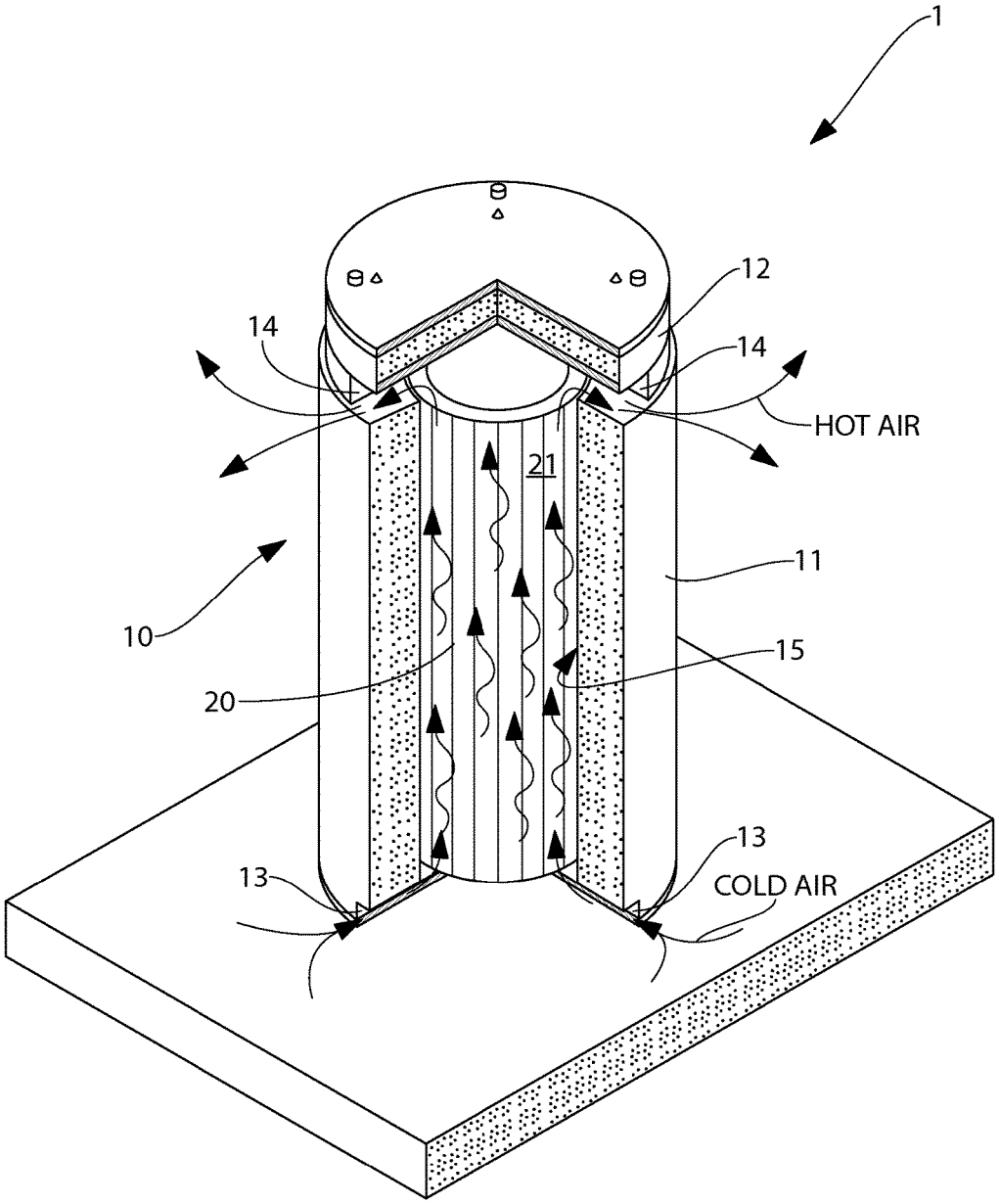
FIG. 1 (Prior Art)
FIG. 1 is a perspective view of a prior art ventilated storage system.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal" "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring to FIG. 1, a prior art ventilated system 1 is shown. The prior art ventilated system 1 comprises ventilated cask 10 that comprises a cylindrical cask body 11 and a cask lid 12. The cylindrical cask body 11 comprises a set of air inlet ducts 13 near its bottom and a set of air outlet ducts 14 near its top. A dry storage canister 20 containing decaying spent nuclear fuel stands upright inside the VVO 10 with a small diametral clearance, in the form an annular gap 15, being, formed between an inner surface of the cylindrical cask body 12 of the VVO 10 and the outer surface 21 of the canister 20. The outer surface 21 of the canister 20 becomes heated due to the thermal energy being generated by the spent nuclear fuel sealed in the canister 20. The heat outer surface 21 causes the surrounding air column to heat and rise, resulting in a continuous natural convective ventilation action. The cold air entering the air inlet duets 14 at the bottom of the cylindrical cask body 12 is progressively heated as it rises in the annular gap 15, reaching its maximum value as it its the cylindrical cask body 12.

Figure 2:
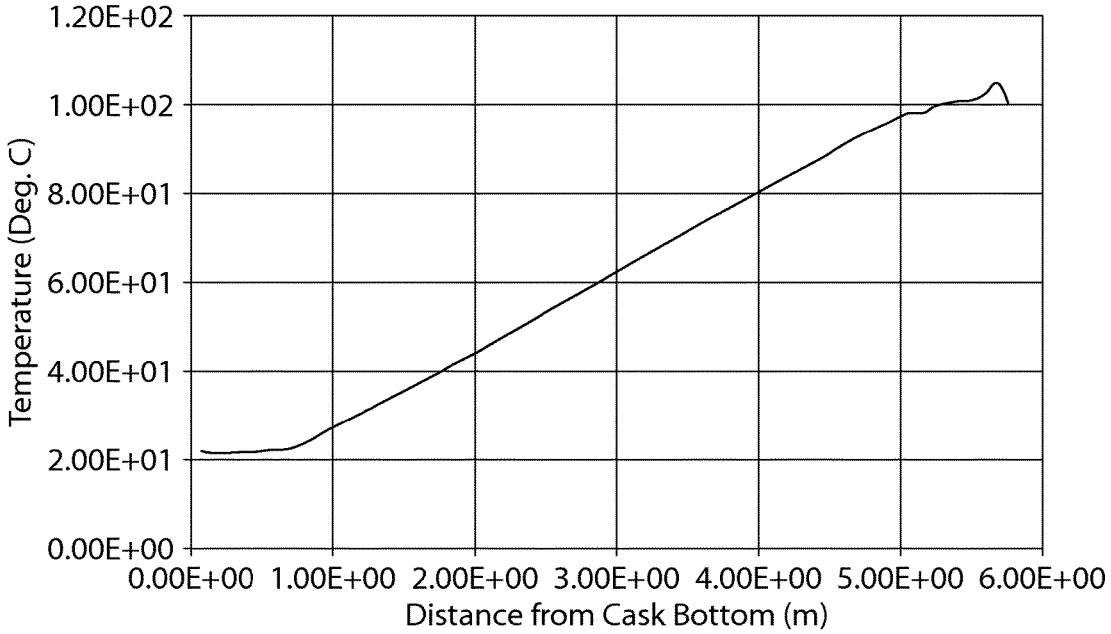
FIG. 2 is a graph of air temperature as a function of distance from the bottom end of the cask body within the ventilated cask of the prior art ventilated storage system of FIG. 1 when a canister loaded with high level radioactive waste having a heat load is positioned within the ventilated cask.
Figure 3:
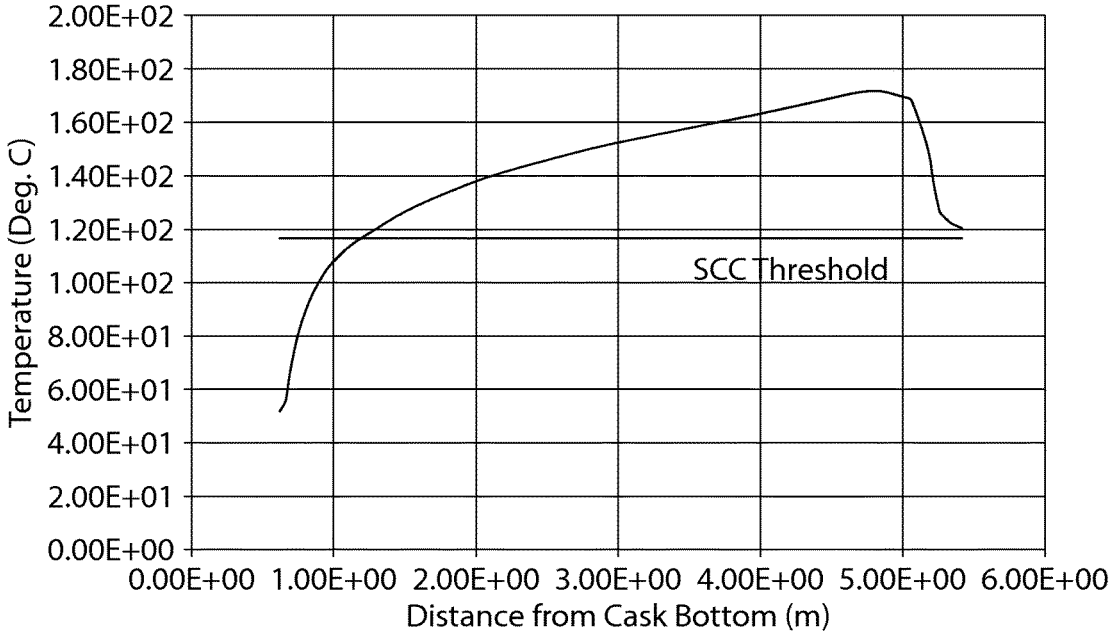
FIG. 3 is a graph of the temperature of the outer surface of the canister as a function of distance from the bottom end of the cask body when the canister is stored in the ventilated cask of the prior art ventilated storage system of FIG. 1.

The metal temperature of the canister 20 (which is typically made of austenitic stainless steel) likewise increases with increasing height (i.e., vertical distance from the bottom of the canister 20), more rapidly in the bottom half of the canister 20 where the ΔT between the air temperature and the canister temperature is larger than the top half where the ΔT between the air temperature and the canister temperature is less. A larger ΔT draws results in the heat of the canister 20 being drawn out and away more vigorously. Referring to FIGS. 2 and 3, typical an and canister temperatures, as a function of canister height, are graphed for the prior art ventilated system 1 @ a 28.74 kW heat load (of the spent nuclear fuel) and a 26.6° C. temperature for the ambient cooling air using an axisymmetric model in the computer code FLUENT. As FIG. 3 shows, the surface temperature of the canister is within 90° C. of the ambient air temperature at a reference of 26.6° C. for approximately 10.4% of its height.

The region where the canister surface temperature is within the range of 90° C. above the ambient temperature has been identified by research as a potential "vulnerable zone" to SCC, especially in marine environments. This is particularly true of weld seams and heat affected zones in the canister's confinement boundary. Thus, weld seams in canisters of ISFSIs located at coastal sites, i.e., those on the Atlantic and Pacific coasts, are especially vulnerable to SCC. Moreover, as the spent nuclear fuel decays with the passage of time, the emitted heat generation rate drops as well, which puts more and more of the canister surface in the "vulnerable zone" (i.e., within 90° C. of the ambient air temperature). This potential degradation of the canister's confinement boundary is inconsistent with the evolving policy to extend the service life of ISFSIs by many decades.

Figure 4:
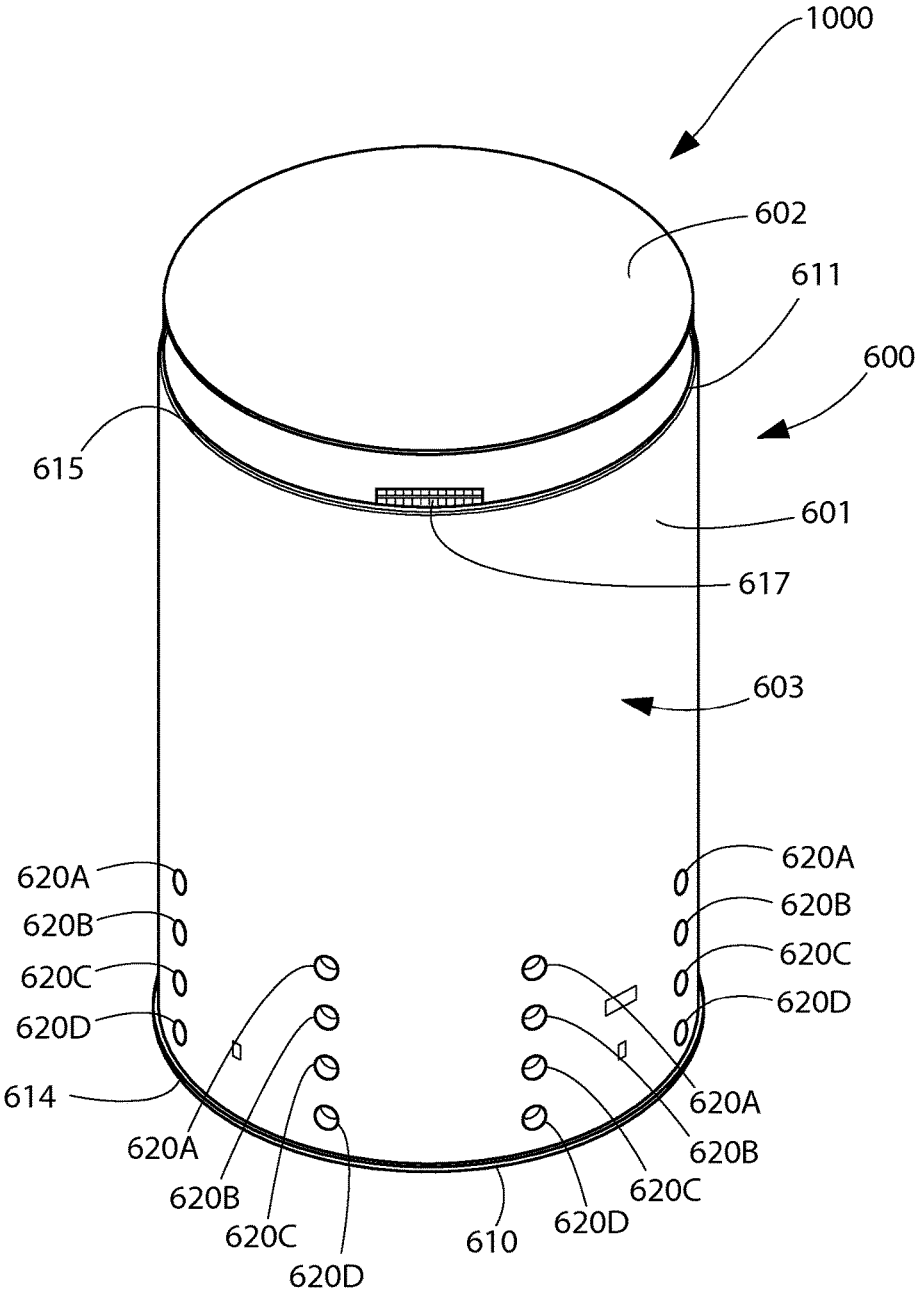
FIG. 4 is a perspective view of a ventilated system according to an embodiment of the present invention.
Figure 5:
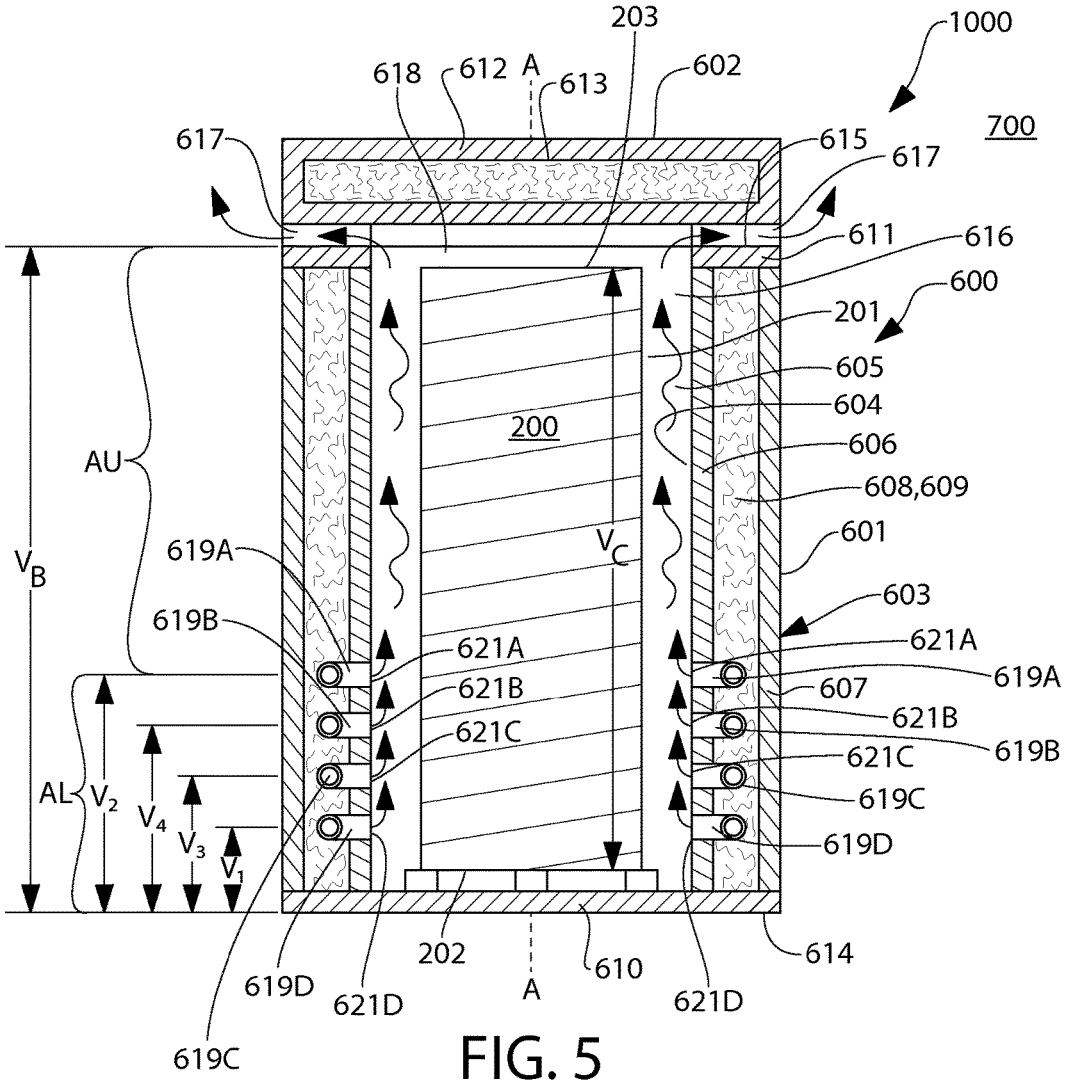
FIG. 5 is a schematic cross-sectional view of the ventilated system of FIG. 4.
Figure 6:
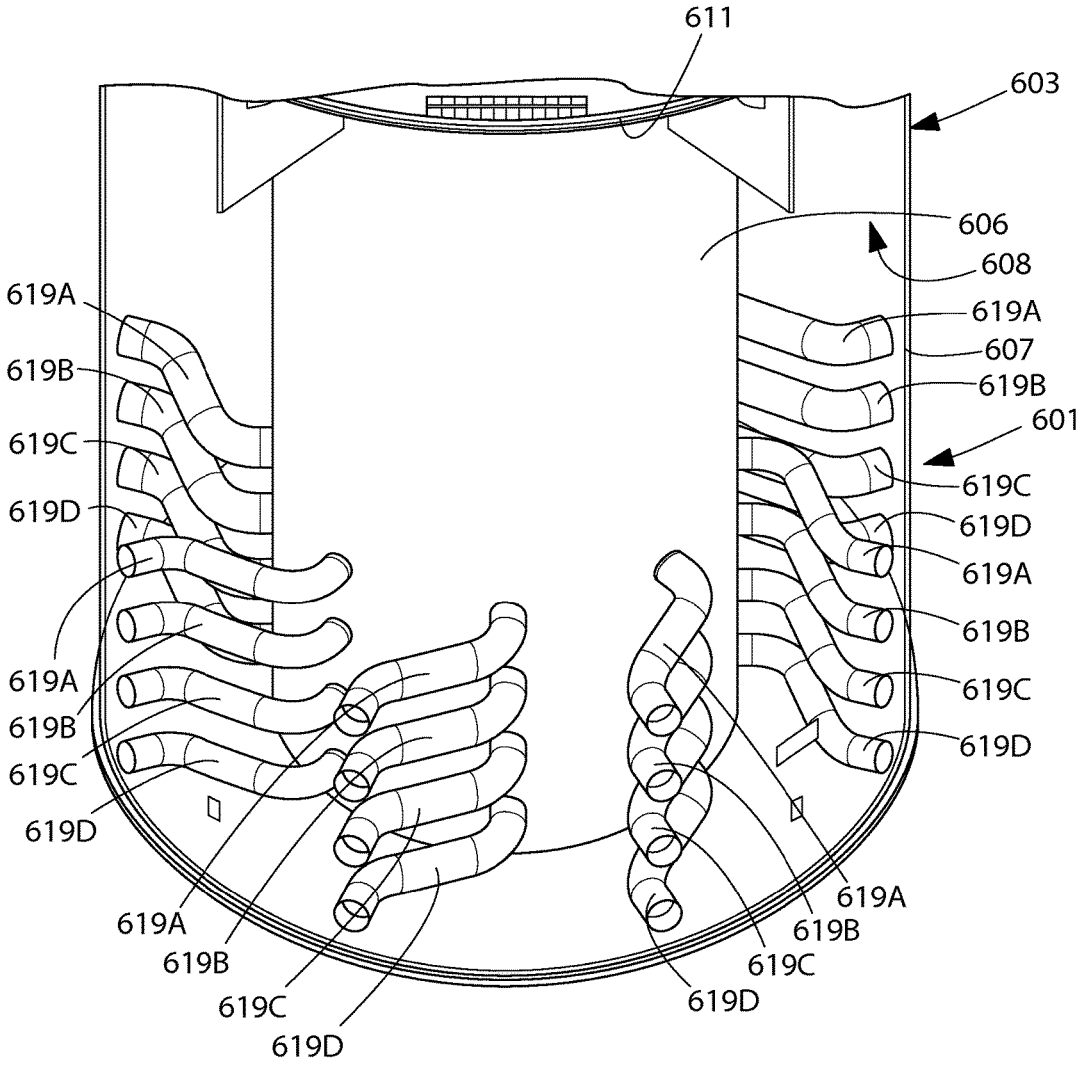
FIG. 6 is a perspective view of the cask body of the ventilated system of FIG. 4 wherein a portion of the outer metal shell is cut-away and the concrete fill has been removed from the annulus to reveal the inlet ducts.
Figure 7:
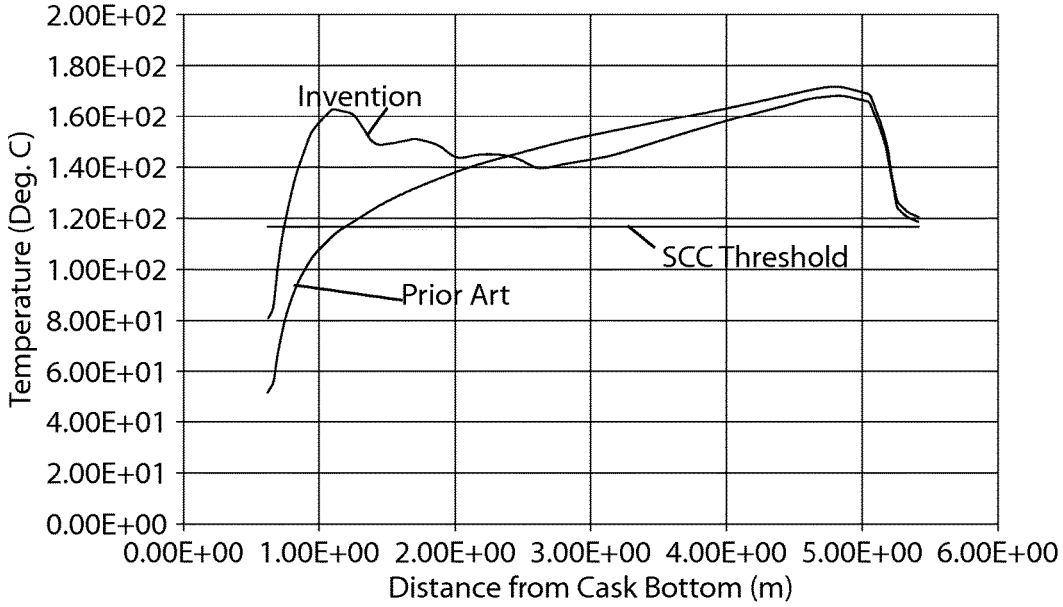
FIG. 7 is a comparative graph of the temperature of the outer surface of a canister as a function of distance from a bottom end of a cask body when stored in the ventilated system of the present invention as opposed to being stored in the prior art ventilated cask of FIG. 1.

Referring now to FIGS. 4-6 concurrently, a ventilated storage system 1000 according to an embodiment of the present invention is illustrated. The ventilated storage system 1000. The ventilated storage system 1000 is a vertical, ventilated, dry, SNIT storage overpack that is fully compatible with 1000 ton and 125 ton transfer casks for spent fuel canister transfer operations. The ventilated cask 50 can, of course, be modified and/or designed to be compatible with any size or style of transfer cask. Moreover, while the ventilated storage system 1000 is discussed herein as being used to store SNF, it is to be understood that the invention is not so limited and that, in certain circumstances, the ventilated storage system 1000 can be used to store other forms of radioactive waste that is emitting a heat load, such as any high level radioactive waste.

The ventilated storage system 1000 generally comprises a hermetically sealed metal canister 200 and a ventilated cask 600. The canister 200 forms a fluidic containment boundary about the SNF loaded therein. Thus, the canister 200 can be considered a hermetically sealed pressure vessel. The canister 200, however, is thermally conductive so that heat generated by the SNF loaded therein is conducted to its outer surface where it can be removed by convection. In one embodiment, the canister 200 is formed of a stainless steel due to its corrosion resistant nature. In other embodiments, the canister 200 can be formed of other metals or metal alloys. Suitable canisters include multi-purpose canisters ("MPCs") and, in certain instances, can include thermally conductive casks that are hermetically sealed for the dry storage of high level radioactive waste. Typically, such canisters comprise a honeycomb basket, or other structure, positioned therein to accommodate a plurality of SNF rods in spaced relation. In one embodiment, the canister 200 is an MPC that is configured to achieve an internal natural cyclical thermosiphon flow within the internal volume of the canister 200. An example of one such MPC is disclosed in U.S. Pat. No. 5,898,747, issued to Singh on Apr. 27, 1999, the entirety of which is hereby incorporated by reference. Another MPC that is particularly suited for use in the ventilated storage system 1000 is disclosed in U.S. Pat. No. 8,135,107, issued to Singh et al. on Mar. 13, 2012, the entirety of which is hereby incorporated by reference.

The ventilated cask 600 is designed to accept the canister 200. The ventilated cask 600, in the exemplified embodiment, is in the style of a ventilated vertical overpack ("VVO") and comprises a cask body 601 and a cask lid 602. However, in other embodiments, the ventilated cask 600 can take on a wide variety of structures, including any type of structure that is used to house the canister and provide adequate radiation shielding for the SNF loaded within the canister.

The ventilated cask 600 generally comprises a cask body 601 and a cask lid 602 positioned atop the cask body 601. The cask body 601 comprises an outer surface 603 and an inner surface 604 that forms a storage cavity 605 for receiving high level radioactive waste, which is in the exemplified embodiment is contained within the canister 200. The cask lid is positioned atop the cask body 601 to encloses a top end of the storage cavity 605. In the exemplified embodiment, the cask body 601 comprises an inner metal shell 606 and an outer metal shell 607 circumferentially surrounding the inner metal shell 600 so that an annulus 608 is formed therebetween. As discussed in greater detail below, the annulus 608 is filled with concrete 609 (or another gamma radiation absorbing material). The cask body 601 further comprises a metal baseplate 610 and an annular top plate 611 that are connected to the bottom and top edges of the inner and outer metal shells 606, 607 respectively. In one embodiment, each of the inner metal shell 606, the outer metal shell 607, the metal baseplate 610 and the annular top plate 611 are formed of a steel, such as carbon steel or stainless steel.

The cask body 600 is a rugged, heavy-walled cylindrical vessel. The main structural function of the cask body 600 is provided by its steel components while the main radiation shielding function is provided by the annular concrete mass 609. The plain concrete mass 609 between the inner and outer metal steel shells 606, 607 is specified to provide the necessary shielding properties (thy density) and compressive strength for the ventilated storage system 1000. The principal function of the concrete mass 609 is to provide shielding against gamma and neutron radiation.

The cask body 602 extends along a longitudinal axis A-A from a bottom end 614 to a top end 615. In the exemplified embodiment, the longitudinal axis A-A is vertically oriented. The cask body has a vertical height $V_B$ measured from the bottom end 614 to the top end 615. The storage cavity 605, in the exemplified embodiment, has a transverse cross-sectional that accommodates no more than one of the canister 200. When the canister 200 containing high level radioactive waste is positioned within the storage cavity 605, an annular gap 616 exists between an outer surface 201 of the canister 200 and the inner surface 604 of the cask body 601. As will be discussed in greater detail below, the annular gap 616 forms a vertical annular passageway from the plurality of the inlet ducts to the outlet ducts so that natural convective cooling of the canister 200 can be achieved.

The cask lid 602 is a weldment of steel plates 612 filled with a plain concrete mass 613 that provides neutron and gamma attenuation to minimize skyshine. The cask lid 602 is removably secured to the top end 615 of the cask body 601. When secured to the cask body 601, surface contact between the cask lid 602 and the cask body 601 forms a lid-to-body interface. The cask lid 601 is preferably non-fixedly secured to the cask body 601 and encloses the top end of the storage cavity 10 formed by the cask body 601.

The ventilated cask 600 further comprises a plurality of outlet ducts 617 extending from a top 618 of the storage cavity 605 to an ambient atmosphere 700. In the exemplified embodiment, the plurality of outlet ducts 617 are formed in the cask lid 602. However, in alternate embodiments, the plurality of outlet ducts 617 can be formed in the cask body 301. The plurality of outlet ducts 617 allow heated air that rises within the annular gap 616 and gather within the top 618 of the storage cavity 605 to exit the ventilates cask 600.

The ventilated cask 600 further comprises a plurality of inlet ducts 619A-D. Each of the inlet ducts 619-A-D extend from a first opening 620A-D in the outer surface 603 of the cask body 601 to a second opening 621A-D in the inner surface 604 of the cask body 604. In the exemplified embodiment, the plurality of filet ducts 619A-D comprise an uppermost set of inlet ducts 619A, a first middle set of inlet ducts 619B, a second middle set of inlet ducts 619C, and a lowermost set of inlet ducts 619B. In certain other embodiments, more or less sets of inlet ducts can be used as desired. As shown in FIG. 5, the second openings 621D of the lowermost set of air inlet ducts 619D are located at a first vertical distance $V_1$ from the bottom end 614 of the cask body 61. The second openings 621A of the uppermost set of air inlet ducts 619A are located at a second vertical distance $V_2$ from the bottom end 614 of the cask body 601. The second openings 621C of the first middle set of inlet ducts 619C are at a third vertical distance $V_3$ from the bottom end 614 of the cask body 601. The second openings 621B of the second middle set of inlet ducts 619B are at a fourth vertical distance $V_4$ from the bottom end 614 of the cask body 601. The second vertical distance $V_2$ is greater than the first vertical distance $V_1$. The third vertical distance $V_3$ is greater than the first vertical distance $V_1$ and less than the second vertical distance $V_2$. The fourth vertical distance $V_4$ is greater than the third vertical distance $V_3$ and less than the second vertical distance $V_2$. In certain embodiments, the second vertical height $V_2$ is equal to or less than 50% of the vertical height $V_B$ of the cask body 601. In another embodiment, the second height $V_2$ is greater than or equal to 20% of the vertical height $V_B$ of the cask body 601. In still another embodiment, the second vertical height $V_2$ is in a range of 20% to 50% of the vertical height $V_B$ of the cask body 601.

The plurality of inlet ducts 619A-D are metal tubes that are located within the annulus 608 and extend between the first openings 620A-D, which are formed in the outer metal shell 607, and the second openings 621A-D, which are formed in the inner metal shell 606. The remaining volume of the annulus 608 is filled with concrete and, thus, the plurality of inlet ducts 619A-D are embedded in the concrete 609.

Each of the plurality of inlet ducts 619A-D forms a tortuous path through the cask body 601 such that a line of sight does not exist from the storage cavity 605 to outside 700 of the cask body 601. Thus, radiation cannot escape through the inlet ducts 619A-D despite being at the same height as the canister 200. As can best be seen in FIG. 6, each of the plurality of inlet vents 619A-D is independent and distinct from all other ones of the plurality of inlet vents 619A-D along the entire length thereof.

The second openings 621A-D of all of the sets of inlet ducts 619A-D are circumferentially arranged about the longitudinal axis A-A of the cask body 601 (which is also the longitudinal axis A-A of the storage cavity 605) in an equi-spaced symmetric manner. Moreover, in the exemplified embodiment, the second openings 621A-D of all of the sets of inlet ducts 619A-D are also in vertical alignment each other in columns. In other embodiments, the second openings 621A-D of all of the sets of inlet ducts 619A-D can be vertically offset from set to set. In eon embodiment, each of the sets of inlet ducts 619A-D comprises at least six of the inlet ducts. In another embodiment, each of the sets of inlet ducts 619A-D comprises at least eight of the inlet ducts. In other embodiments, each of the sets of inlet ducts 619A-D may include more or less inlet ducts. Moreover in one embodiment, the number of inlet ducts may vary between the sets of inlet ducts 619A-D.

The lowermost set of inlet ducts 619D collectively have a first effective cross-sectional area. The uppermost set of inlet ducts 619A collectively have a second effective cross-sectional area. In one embodiment, the second effective cross-sectional area is greater than the first effective cross-sectional area. In other embodiments, the first middle set of inlet ducts 619C collectively have a third effective cross-sectional area while the second middle set of inlet ducts 619B collectively have a fourth effective cross-sectional area. In one embodiment, each of the third and fourth effective cross-sectional areas is greater than the first effective cross-sectional area. In another embodiment, each of the second, third and fourth effective cross-sectional areas are substantially equal to one another and greater than the first effective cross-sectional area The second openings 621A-D of the plurality of inlet ducts 619A-D are arranged in a pattern on the inner surface 604 of the cask body 601. As will be described in greater detail below, this pattern and the second vertical distance $V_2$ are selected to maintain more than 90% of the vertical height $V_C$ of the metal canister above a predetermined threshold temperature at a predetermined heat generation rate of the high level radioactive waste stored therein. The vertical height $V_C$ of the canister 200 is measured from a bottom end 202 of the canister to a top end 203 of the canister 200.

In the exemplified embodiment, the second openings 621A-D are arranged in a pattern of horizontally aligned rows and vertically aligned columns. In certain other embodiments, however, the second openings 621A-D are arranged in a pattern that does not include distinct sets of the second openings 621A-D (or sets of the inlet ducts 619A-D). In one such pattern, the second openings 621A-D are arranged in a horizontally and vertically staggered manner.

The cask body 601, in certain embodiments, can be conceptually divided into a lower axial section AL and an upper axial section AU. The lower axial section AL is defined from the bottom end 614 of the cask body 601 to the vertical height of an uppermost one of the second openings 621A-D of the plurality of air inlet ducts 619A-D. Thus, all of the second openings 621A-D of the plurality of air inlet ducts 619A-D will be located in the lower axial section AL. The upper axial section AU is defined from the top end 615 of the cask body 601 to the vertical height of the uppermost one of the second openings 621A-D of the plurality air inlet ducts 619A-D. Thus, the upper axial section AU is free of the second openings 621A-D of the plurality of air inlet ducts 619A-D.

In such an embodiment, the pattern of the second openings 621A-D is configured and the vertical height of the uppermost one of the second openings 621A-D is selected to maintain more than 90% of a vertical height of the metal canister 200 above a predetermined threshold temperature for a predetermined heat generation rate of the high level radioactive waste. In another embodiment, the pattern of the second openings 621A-D is configured and the vertical height of the uppermost one of the second openings 621A-D is selected to maintain more than 95% of the vertical height of the metal canister 200 above the predetermined threshold temperature for the predetermined heat generation rate of the high level radioactive waste. In even another embodiment, the pattern of the second openings 621A-D is configured and the vertical height of the uppermost one of the second openings 621A-D is selected to maintain more than 97% of the vertical height of the metal canister 200 above the predetermined threshold temperature for the predetermined heat generation rate of the high level radioactive waste.

In one embodiment, the predetermined threshold temperature is the sum of an ambient air temperature outside 7000 of the ventilated cask 600 and a positive temperature value. In one embodiment, the positive temperature value is equal to or greater than about 90 degrees Celsius to prevent SCC.

The ventilated system 100 can timber comprises a plurality of plugs detachably coupled to the cask to body 601 to seal the plurality of inlet ducts 619A-D to accommodate for decay of the heat generation rate of the high level radioactive waste.

As set forth above, the cask body 601 comprises a large number of small circumferentially and vertically distributed inlet ducts 619-A-D. The inlet ducts 619A-D are sufficiently small and curved so that they don't permit radiation streaming. The inlet ducts 619A-D are located in the bottom half of the cask body 601 while the outlet duct(s) 617 is/are located in the top region as of the ventilated cask 600. The new configuration of the inlet ducts 619A-D reduces the air flow in the bottom region of the storage cavity 605, causing the metal surface temperature of the canister 200 to become elevated. In addition, air isolator channels (AICs) can be used to shield the weld seams of the canister 200 and the adjacent heat affected zones from the cooling action of flowing ventilation air. The AICs can be made of spring steel connected to the cask body 601. The combined effect of the AICs and the distributed air inlets 619-A-D is to elevate the surface temperature of the most SCC prone portions of the canister 200 out of the vulnerable range ("the V-zone").

Finally, as the heat emission rate in the high level radioactive waste within the canister 200 decreases, the small inlet ducts 619A-D can be capped/sealed so that the canister surface 201 temperature is maintained above the V-zone (i.e., above the predetermined threshold temperature). In cold conditions and after many years of decay, it is entirely conceivable that all inlet vents 619A-D are capped, and even the outlet vent(s) 617 are capped. After the need for ventilation no longer exists, it may be prudent to fill the annulus gap 616 with inert gas (say, nitrogen) to permanently banish the specter of SCC and hermetically seal the storage cavity 605.

To evaluate effectiveness of the enhanced design, the cask body 601 is modified for a representative case wherein the bottom ducts area is distributed to inlet ducts placed at four elevations 0 ft, 4.8 ft, 6.8 ft and 8.8 ft in the ratio of 1:3:3:3. The modified cask body 601 is analyzed using the FLUENT axisymmetric model at the same conditions as the prior art ventilated system of FIG. 1 (28.74 kW heat load and 26.6 deg. C. ambient temperature). The canister axial temperature profile is shown in FIG. 6 for the ventilation system 1000 of the present invention with the profile for the prior art ventilated system 1 superimposed for comparison purpose. The results show the following: (1) the present invention works as intended by raising the temperature of the cold bottom end of the canister substantially; (2) the distributed design of the inlets 619A-D greatly diminishes the SCC prone length (the affected length is reduced from 10.4% to 2.4%); and (3) the maximum shell temperatures reached in the upper region of the canister 200 are essentially identical (this provides reasonable assurance that fuel temperatures inside the canister 200 are not affected by the distributed design of the inlets ducts 619A-D).

When the canister 200 is loaded with SNF and positioned within the storage cavity 605, heat generated by the SNF within the canister 200 conducts to the outer surface 201 of the canister 200. This heat then warms the air located within the annular gap 616. As a result of being heated, this warmed air rises within the annular gap 616 and eventually exits the ventilated cask 600 via the outlet ducts 617 as heated air. Due to a thermosiphon effect created by the exiting heated air, cool air is drawn into the inlet ducts 618A-D. This cool air flows through the inlet ducts 619A-D and is the drawn upward into the annular gap 616 where it becomes heated and begins to rise, thereby creating a continuous cycle, known as the chimney-effect. Thus, the heat generated by the SNF within the canister 200 causes a natural convective flow of air through a ventilation passageway of the ventilated cask 600. In the exemplified embodiment, the ventilation passageway is collectively formed by the inlet ducts 619A-D, the annular gap 616 and the outlet ducts 617. In the exemplified embodiment, the ventilated cask 600 is free of forced cooling equipment, such as blowers and closed-loop cooling systems. The rate of air flow through the ventilation passageway of the ventilated cask 600 is governed, in part, by the heat generation rate of the SNF within the canister 200 and the number of inlet ventilation ducts 619A-D that are open.

In accordance with a method of the present invention, the metal canister 200 containing high level radioactive waste having a heat generation rate is positioned in the storage cavity 605. The cask lid 602 is positioned atop the cask body 601. As time passes, the heat generation rate of the high level radioactive waste decreases. Thus, in order to keep the outer surface 201 of the canister above the desired SCC threshold, selected ones of the plurality of inlet ducts 619A-B are sealed over time as a function of the decay of the heat generation rate to maintain a predetermined percentage of a vertical height of the metal canister 200 above a predetermined threshold temperature. Sealing of selected ones of the plurality of inlet ducts 619A-B reduces the natural convective flow rate of air through the storage cavity 605. In one embodiment, a first set of the plurality of inlet ducts are sealed at a first point in time. In one example, the first set of the plurality of inlet ducts can be the lowermost ventilation ducts 619D. As the heat generation rate of the high level radioactive waste continues to decrease, it will become necessary to further reduce the convective air flow through the ventilated cask 600. Thus, at a second later point in time, a second set of the plurality of inlet ducts are sealed, which can be the second middle set of inlet ducts 619C. In one embodiment, sealing of the inlet ducts continues and the inlet ducts 619A-D are sealed in sets moving upward from the bottom end 614 as time passes According to the present invention, it can be seen that utilizing a plurality of inlet vents 619A-D that are decreased in size and spread out (as compared to prior art ventilated cask 1) so as to introduce cool air into the storage cavity 605 over an increased height of the canister 200 results in an increased portion of the outer surface 201 of the canister 200 remaining above the SCC threshold temperature for an increased period of time. Thus, the dangers associated with SCC are minimized.

As used throughout, ranges are used as shorthand for describing each and value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

What is claimed is:

1. A ventilated system for storing high level radioactive waste comprising:

a cask body comprising an outer surface and an inner surface forming a storage cavity for receiving high level radioactive waste, the cask body extending along a longitudinal axis from a bottom end of the cask body to a top end of the cask body and having a vertical height measured from the bottom end of the cask body to the top end of the cask body;

a cask lid positioned atop the cask body and enclosing a top end of the storage cavity;

at least one outlet duct extending from a top of the storage cavity to an ambient atmosphere;

a plurality of inlet ducts, each of the inlet ducts extending from a first opening in the outer surface of the cask body to a second opening in the inner surface of the cask body, the plurality of inlet ducts comprising a lowermost set of inlet ducts and an uppermost set of inlet ducts;

wherein the second openings of the lowermost set of inlet ducts are located at a first vertical distance from the bottom end of the cask body and the second openings of the uppermost set of inlet ducts are located at a second vertical distance from the bottom end of the cask body, the second vertical distance being greater than the first vertical distance and being equal to or less than 50% of the vertical height of the cask body; and wherein the cask body is devoid of any inlet ducts between the uppermost set of inlet ducts and the top end of the cask body in a direction of the longitudinal axis.

2. The ventilated system according to claim 1 wherein the second openings of both the uppermost set of inlet ducts and the lowermost set of inlet ducts are circumferentially arranged about a longitudinal axis of the storage cavity in an equi-spaced symmetric manner.

3. The ventilated system according to claim 1 wherein the second openings of the uppermost set of inlet ducts are in vertical alignment with the second openings of the lowermost set of inlet ducts.

4. The ventilated system according to claim 1 wherein each of the lowermost and uppermost sets of inlets ducts comprises at least six of the inlet ducts.

5. The ventilated system according to claim 1 wherein the plurality of inlet ducts comprises a first middle set of inlet ducts, wherein the second openings of the first middle set of inlet ducts are at a third vertical distance from the bottom end of the cask body, the third vertical distance being greater than the first vertical distance and less than the second vertical distance.

6. The ventilated system according to claim 5 wherein the plurality of inlet ducts comprises a second middle set of inlet ducts, wherein the second openings of the second middle set of inlet ducts are at a fourth vertical distance from the bottom end of the cask body, the fourth vertical distance being greater than the third vertical distance and less than the second vertical distance.

7. The ventilated system according to claim 1 wherein the first opening of each of the inlet ducts is radially offset from the second opening of each of the inlet ducts.

8. The ventilated system according to claim 1 wherein the second vertical distance is greater than or equal to 20% of the vertical height of the cask body.

9. The ventilated system according to claim 1 wherein the cask body comprises an inner metal shell and an outer metal shell circumferentially surrounding the inner metal shell so that an annulus is formed therebetween, and wherein the plurality of inlet ducts comprise metal tubes located within the annulus and extending between the first openings which are formed in the outer metal shell and the second openings which are formed in the inner metal shell, and wherein a remaining volume of the annulus is filled with concrete.

10. The ventilated system according to claim 1 wherein each of the plurality of inlet ducts forms a tortuous path through the cask body such that a line of sight does not exist from the storage cavity to outside of the cask body.

11. The ventilated system according to claim 1 wherein each of the plurality of inlet ducts is independent and distinct from all other ones of the plurality of inlet ducts along an entire length thereof.

12. The ventilated system according to claim 1 wherein the lowermost set of inlet ducts have a first effective cross-sectional area and the uppermost set of inlet ducts have a second effective cross-sectional area, and wherein the second effective cross-sectional area is greater than the first effective cross-sectional area.

13. The ventilated system according to claim 1 further comprising a hermetically sealed metal canister containing high level radioactive waste, the metal canister positioned within the storage cavity so that an annular gap exists between an outer surface of the metal canister and the inner surface of the cask body, the annular gap forming a passageway from the second openings of the plurality of the inlet ducts to the at least one outlet duct.

14. The ventilated system according to claim 13 wherein the second openings of the plurality of inlet ducts are arranged in a pattern on the inner surface of the cask body, and wherein the pattern and the second vertical distance are configured to maintain more than 90% of a vertical height of the metal canister above a predetermined threshold temperature at a predetermined heat generation rate of the high level radioactive waste.

15. A ventilated system for storing high level radioactive waste comprising:

a cask body comprising a bottom end, a top end, an outer surface and an inner surface, the inner surface forming a storage cavity for receiving high level radioactive waste, the cask body extending along a vertical axis from the bottom end to the top end and having a vertical height measured from the bottom end of the cask body to the top end of the cask body;

a cask lid positioned atop the cask body and enclosing a top end of the storage cavity;

at least one outlet duct extending from a top of the storage cavity to an ambient atmosphere;

a plurality of inlet ducts, each of the inlet ducts extending from a first opening in the outer surface of the cask body to a second opening in the inner surface of the cask body;

the cask body comprising a lower axial section and an upper axial section, wherein the lower axial section is defined from the bottom end of the cask body to a vertical height of an uppermost one of the second openings of the plurality of inlet ducts, the lower axial section defining 50% or less of the vertical height of the cask body, and wherein the upper axial section is defined from the top end of the cask body to the vertical height of the uppermost one of the second openings of the plurality of inlet ducts, the upper axial section being free of any inlet ducts;

a metal canister containing high level radioactive waste positioned within the storage cavity so that an annular gap exists between an outer surface of the metal canister and the inner surface of the cask body, the annular gap forming a passageway from the second openings of the plurality of the inlet ducts to the at least one outlet duct;

the second openings of the plurality of inlet ducts arranged in a pattern on the inner surface of the cask body along the lower axial section; and wherein the pattern is configured and the vertical height of the uppermost one of the second openings is selected to maintain more than 90% of a vertical height of the metal canister above a predetermined threshold temperature for a predetermined heat generation rate of the high level radioactive waste.

16. The ventilated system according to claim 15 wherein the predetermined threshold temperature is the sum of an ambient air temperature and a positive temperature value.

17. The ventilated system according to claim 16 wherein the positive temperature value is equal to or greater than about 90 degrees Celsius.

18. The ventilated system according to claim 15 wherein the pattern is configured and the vertical height of the uppermost one of the second openings is selected to maintain more than 95% of the vertical height of the metal canister above the predetermined threshold temperature for the predetermined heat generation rate of the high level radioactive waste.

19. A method of storing high level radioactive waste comprising:

a) positioning a metal canister containing high level radioactive waste having a heat generation rate in a storage cavity of a ventilated system comprising a cask body, a cask lid positioned atop the cask body, at least one outlet duct extending from a top of the storage cavity to an ambient atmosphere, and a plurality of inlet ducts, each of the inlet ducts extending from a first opening in the outer surface of the cask body to a second opening in the inner surface of the cask body;

b) sealing selected ones of the plurality of inlet ducts over time as a function of a decay of the heat generation rate to maintain a predetermined percentage of a vertical height of the metal canister above a predetermined threshold temperature; and wherein step b) comprises: b-1) sealing a first set of the plurality of inlet ducts at a first time, the first set of the plurality of inlet ducts located at a first vertical height above a bottom end of the cask body; and b-2) sealing a second set of the plurality of inlet ducts at a second time that is subsequent to the first time, the second set of the plurality of inlet ducts located at a second vertical height above the bottom end of the cask body, wherein the second vertical height is greater than the first vertical height.

20. The method according to claim 19 wherein said sealing of selected ones of the plurality of inlet ducts reduces the natural convective flow rate of air through the storage cavity.

21. The method according to claim 19 wherein the predetermined percentage is greater than 90%.

22. The method according to claim 21 wherein the predetermined percentage is greater than 95%.

23. The method according to claim 19 wherein the predetermined threshold temperature is the sum of an ambient air temperature and a positive temperature value.

24. The method according to claim 23 wherein the positive temperature value is equal to or greater than about 90 degrees Celsius.

25. The method according to claim 19 wherein the predetermined threshold temperature is a stress crack corrosion threshold.

* * * * *